US008422720B2

(12) United States Patent
Johannesen

(10) Patent No.: US 8,422,720 B2
(45) Date of Patent: Apr. 16, 2013

(54) SPEAKER ARRANGEMENT

(75) Inventor: Ejnar Johannesen, Struer (DK)

(73) Assignee: Bang & Olufsen A/S, Struer (DK)

( * ) Notice: Subject to any disclaimer, the term of this patent is extended or adjusted under 35 U.S.C. 154(b) by 577 days.

(21) Appl. No.: 12/378,587

(22) Filed: Feb. 17, 2009

(65) Prior Publication Data

US 2009/0208041 A1 Aug. 20, 2009

Related U.S. Application Data

(60) Provisional application No. 61/126,658, filed on May 6, 2008, provisional application No. 61/201,503, filed on Dec. 11, 2008.

(30) Foreign Application Priority Data

Feb. 15, 2008 (DK) ..... 2008 00213

(51) Int. Cl.
*H04R 25/00* (2006.01)

(52) U.S. Cl.
USPC ..... 381/386; 381/87; 381/205; 381/388; 381/338; 381/340

(58) Field of Classification Search ..... 381/333, 381/300, 388, 386, 306, 87, 24, 332, 160, 381/205, 336, 387, 389, 337–341
See application file for complete search history.

(56) References Cited

U.S. PATENT DOCUMENTS

| | | | | | |
|---|---|---|---|---|---|
| 4,475,620 | A * | 10/1984 | Carlsson | 181/146 |
| 5,400,408 | A * | 3/1995 | Lundgren et al. | 381/306 |
| 5,732,140 | A * | 3/1998 | Thayer | 381/300 |
| 6,304,435 | B1 * | 10/2001 | Hsu | 361/679.23 |
| 6,359,994 | B1 * | 3/2002 | Markow et al. | 381/333 |
| 6,807,051 | B2 * | 10/2004 | Takahashi | 361/679.23 |
| 6,996,243 | B2 * | 2/2006 | Welker et al. | 381/160 |
| 7,184,562 | B2 * | 2/2007 | Seki et al. | 381/160 |
| 7,418,104 | B2 * | 8/2008 | Spinale | 381/87 |
| 2006/0008103 | A1 * | 1/2006 | Takahashi et al. | 381/333 |
| 2009/0169045 | A1 * | 7/2009 | Liu et al. | 381/388 |

FOREIGN PATENT DOCUMENTS

| | | | |
|---|---|---|---|
| EP | 0 303 912 | | 2/1989 |
| EP | 1 617 699 | | 1/2006 |
| JP | 2003/134421 | | 5/2003 |
| JP | 2007-235283 | * | 1/2006 |
| JP | 2007/235283 | | 9/2007 |

* cited by examiner

*Primary Examiner* — Colleen Matthews
*Assistant Examiner* — Galina Yushina
(74) *Attorney, Agent, or Firm* — James Creighton Wray

(57) ABSTRACT

A loudspeaker assembly arranged in a surrounding surface of a multimedia apparatus, wherein the loudspeaker assembly including a transducer unit, the transducer unit being located at the back side of the multimedia apparatus. The transducer may be configured so to radiate sound away from the apparatus in directions from primarily upward to primarily backward relative to the apparatus. Each of the one or more transducer units are driven as active speakers with means for amplification per each transducer unit.

8 Claims, 1 Drawing Sheet

SPEAKER ARRANGEMENT

This application claims the benefit of Danish Application No. PA 2008 00213 filed Feb. 15, 2008, U.S. Provisional Application No. 61/126,658 filed May 6, 2008 and U.S. Provisional Application No. 61/201,503 Dec. 11, 2008, which are hereby incorporated in their entirety.

FIELD OF THE INVENTION

The present invention relates to improvements in sound experience as perceived by the user in a listening room. Specifically—but not exclusively the means addresses how to obtain increased loudspeaker performance in consumer electronics like a flat panel LCD screen and lap top computers.

BACKGROUND OF THE INVENTION

Typically the sound performance and sound quality offered in standard flat screen TV's, LCD based screen monitors and lap top computers are very poor, due to the fact that the physical design and outline of the equipment does not allow the needed space/volume required to obtain a decent acoustical quality in the built-in speaker arrangement.

This paradox become worse when the sound sources, i.e. media files offer surround sound quality as multichannel systems to be delivered to the user. Prior art equipment cant reproduce the user expected sound experience via the traditional built in speaker systems.

Especially the low frequency sound reproduction is very poor in the prior art loudspeaker systems applied in multi media equipment.

From EP 0303912 is known a television including a cathode ray tube, CRT (old fashion television), in the cabinet of which are mounted a number of loudspeakers. One of the advantages of the old type of televisions was the fact that a rather bulky housing/cabinet was necessary in order to cover the CRT and the necessary electronic components. The housing helps providing the volume necessary for the speakers to generate/replicate the sound in as high a quality as possible. The television is furthermore provided with a number of different type of loudspeakers arranged in various positions in the cabinet, and relative to the listener such that the volume of the cabinet is utilised.

The flat panel display, known from EP 1617699 on the other hand, does not provide any cabinet volume which could be used for the speakers. The loudspeaker is therefore arranged at the back of the panel in a separate box mounted on the panels' stand. The loudspeaker box may contain a plurality of speakers, which are arranged such that they mainly radiate sound backwards relative to the flat panel. This arrangement uses a wall against which the flat panel display is placed in order to bounce the sound emitted from the loudspeaker towards the listener. One problem with this arrangement is the fact that when it is desirable to have loud sound, and in particularly in the low frequency range, the resonance will affect the flat panel display and possibly distort the picture.

From JP 2003134421 is know a system of attaching a loudspeaker to a chassis of a screen, such that the transmission and influence of vibrations from the speaker on the screen device is mitigated. As well known in the art sound reproduction is to some extend dependent on the loudspeaker cabinet and its volume and/or shape. The system according to JP 2003134421 firstly does not fixate the speaker but relies on the speaker unit staying in place by the action of rubber bands. Furthermore it does not disclose how the loudspeaker unit interacts with a cabinet, or if it utilises the screen devices' cabinet/housing. The simple fastening by use of rubber strips has a number of drawbacks, such as for example the rubber ages whereby the loudspeaker comes loose from its mounting and may rattle, during movement of the screen, the loudspeaker may become loose or displaced.

Thus the object of the invention is to provide a loudspeaker system concept with enhanced sound quality properties, primarily in the low frequency sound domain:

- Including one or more speaker units in a speaker assembly,
- one or more speaker assemblies are mounted onto a frame of the equipment and mounted via anti vibrating means,
- the one or more speaker assemblies are mounted onto the backside of the equipment, and radiates the sound primarily upwards,
- active loudspeakers are applied for enhanced efficiency.

Sound performance and sound quality in this aspect relates to the ability of the loudspeaker system to reproduce recorded audio information from original source material to be perceived by the listener as natural as possible i.e. identical to the original recorded material, this being the frequency content and the level of the sound pressure.

DESCRIPTION OF THE INVENTION

When describing some aspects of the invention, reference will be made to various planes and axis in a coordinate system. In this connection it is foreseen that the coordinate system is oriented such that a front surface (screen) of a multimedia device, for example a LCD television, is present in an XY plane, and the Z axis is orthogonal to this plane. The X axis being substantially horizontal when the device is in use (a television hanging on a wall), and the Y axis being substantially vertical.

In a first aspect, as set out in claim 1 the invention relates to a speaker system in a consumer electronic product in which the acoustical volume is extended to obtain an increased sound performance and sound quality and where:

- a loudspeaker assembly arranged in a multimedia apparatus (1), wherein the loudspeaker assembly (4) including a transducer unit (5) is located at the back side of the multimedia apparatus, and
- where the surface of the transducer unit position is configured so the sound radiates primarily upwards (6), or
- where the surface of the transducer unit position is configured so the sound radiates primarily backwards (7).

Technically it's a challenge to embed a medium/high volume cabinet into a consumer product that includes an active screen object, e.g. an LCD screen. Acoustical sound vibrations from the speaker may interfere with the display pixel control means of the screen, which implies noise in the picture display and led to a poor picture quality.

To avoid this, the loud loudspeaker assembly is mounted on to the frame of the consumer product via anti vibrating means, such that vibrations from the speaker assembly are isolated from the screen object itself, i.e. anti reflection means absorb the resonance from the speaker units.

In a second aspect of the invention the loudspeaker assembly is an object mounted via anti vibrating means (8,9) onto a part of the chassis frame (2) of the multimedia apparatus (1).

In an alternative embodiment of the invention the loudspeaker assembly is an object mounted via anti vibrating means (8,9) onto a part of the support stand (12) of the multimedia apparatus (1).

According to the actual product requirements, and the size of an actual consumer product, the acoustical volume may vary accordingly. The same apply for the orientation of the speaker units mounted into loudspeaker assembly.

The orientation of the sound radiated from the speaker units may be:

- primarily upwards and vertically aligned, or
- primarily upwards and declined relative to vertical in one of any angle from 0 to 90 deg, or
- primarily backwards and horizontally aligned, or
- primarily backwards and inclined/declined relative to the orthogonal line of the XY plane of the back side of multimedia device in one of any angle from 0 to 90 deg.

In a preferred embodiment the plane of the top front surface (10) of the speaker unit is declined approximately 15 deg (11) relative to the orthogonal line of the XY plane of the back side of multimedia device.

In a third aspect of the invention the surface of the transducer unit position may be configured in one of more alternative positions, obtained by inclining the X,Y plane of the transducer unit in any angles ranged from 0 deg to 180 deg relative to the X,Y plane of the back surface of the multimedia apparatus.

The XY plane of the transducer shall in this context be understood as a plane arranged orthogonally to the transducers main sound radiating direction. A traditional transducers comprises a membrane substantially circular or oval. Centrally is arranged a driver unit behind the membrane. The driver unit typically comprises a magnet system defining an airgap in which a voicecoil coupled to the membrane is arranged. By inducing a current in the voicecoil the magnet system will urge the voicecoil and thereby the membrane to move, thereby creating the sound. The sound is emitted substantially perpendicularly with respect to the membrane. For most transducers of this type the main sound emitting direction will be along a rotation symmetrical central axis through the center of the membrane. This axis corresponds to the transducers Z axis. The XY plane is arranged orthogonally to this axis.

There is therefore within this application a distinction between the axis' relating to the multimedia apparatus and the axis relating to the transducer unit.

In the preferred embodiment the loudspeaker assembly is configured with one loudspeaker unit of woofer type.

But in general the invention includes alternative configurations, according to the size and general performance requirements of the multimedia equipment, configurations like:

- two or more loudspeaker assemblies, each containing two or more loudspeaker units, and
- the loudspeaker units being of any type, like high frequency transducer, medium frequency transducer and low frequency transducer.

In the preferred embodiment an active speaker concept is applied which implies that the one or more transducer units all are driven with individual amplifier and filter means.

The invention is suitable in any consumer electronic product where there are high requirements to the sound performance and sound quality and combined with strong requirement to the industrial design of the product.

This applies for products like, but not limited to:

- Flat screen TV sets, LCD screens/monitors, OLED display and alike.
- Small to large size screens of the above type.
- PC screens or lap top PC's containing screens of the above type.
- Audio/media presentation systems like music players with built in loudspeakers. This applies for devices with or without display means and screens.

DETAILED DESCRIPTION

In the following, preferred embodiments of the invention will be described with reference to the drawing wherein.

Figure 1:
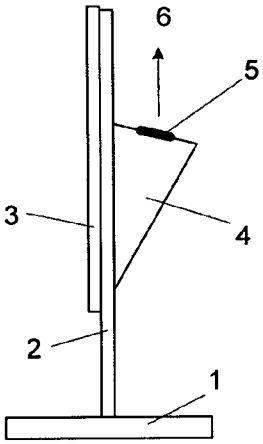
FIG. 1 illustrates a side view of the invention with the speaker unit in the upwards position.

In FIG. 1 a side view illustrates how a loudspeaker assembly (4) is mounted on to the backside of a multimedia device (1), e.g. on the backside of a TV set containing a display screen (3) on the front. The transducer unit (5) is mounted into the loudspeaker assembly (4), and is oriented to radiate sound signals primarily upwards (6). The loudspeaker assembly (4) is mounted by anti vibrating means on to the frame (2) of the device (1).

Figure 2:
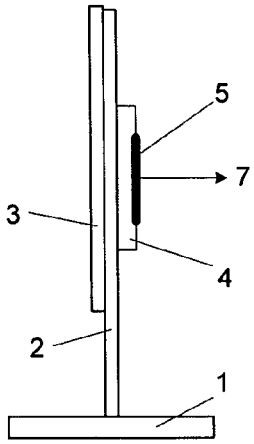
FIG. 2 illustrates a side view of the invention with the speaker unit in the backwards position.

In FIG. 2 a side view illustrates how a loudspeaker assembly (4) is mounted on to the backside of a multimedia device (1), e.g. on the backside of a TV set containing a display screen (3) on the front. The transducer unit (5) is mounted into the loudspeaker assembly (4), and is oriented to radiate sound signals primarily backwards (7). The loudspeaker assembly (4) is mounted by anti vibrating means on to the frame (2) of the device (1).

Figure 3:
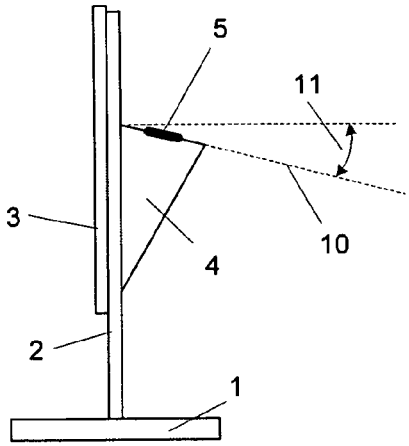
FIG. 3 illustrates a side view of the invention with the speaker in alternative tilting angles.

In FIG. 3 a side view illustrates how a loudspeaker assembly (4) is mounted on to the backside of a multimedia device (1), e.g. on the backside of a TV set containing a display screen (3) on the front. The transducer unit (5) is mounted into the loudspeaker assembly (4), and is oriented to radiate sound signals primarily upwards (6), but optionally in one of any different angles 0→180 deg; as illustrated in the example with an angle of approximately 15 deg (11). The loudspeaker assembly (4) is mounted by anti vibrating means on to the frame (2) of the device (1).

Thus an angle of declination/inclination having the value of 0 deg corresponds to vertical upwards orientation of the sound radiation; and an angle of declination/inclination having the value of 90 deg corresponds to horizontal backwards orientation of the sound radiation.

Figure 4:
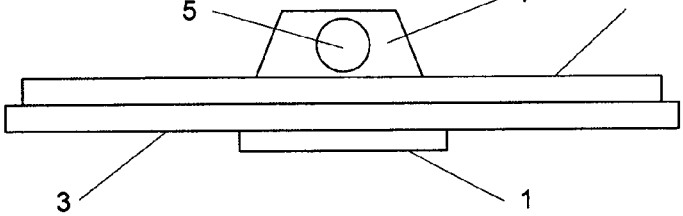
FIG. 4 illustrates a top view of the invention with the speaker unit in the upwards position.

In FIG. 4 a top view illustrates how a loudspeaker assembly (4) is mounted on to the backside of a multimedia device (1), e.g. on the backside of a TV set containing a display screen (3) on the front. The transducer unit (5) is mounted into the loudspeaker assembly (4), and is oriented to radiate sound signals primarily upwards. The loudspeaker assembly (4) is mounted by anti vibrating means on to the frame (2) of the device (1).

Figure 5:
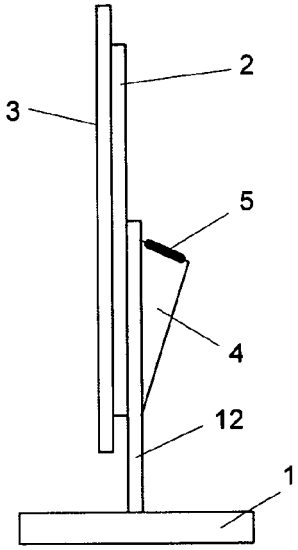
FIG. 5 illustrates a side view of a variant of the invention with the speaker unit in the upwards position.

In FIG. 5 a side view illustrates how a loudspeaker assembly (4) is mounted on to the backside of a multimedia device (1), e.g. on the backside of a TV set containing a display screen (3) on the front. The transducer unit (5) is mounted into the loudspeaker assembly (4), and is oriented to radiate sound signals primarily upwards. The loudspeaker assembly (4) is mounted by anti vibrating means on to the support stand (12) of the device (1).

Figure 6:
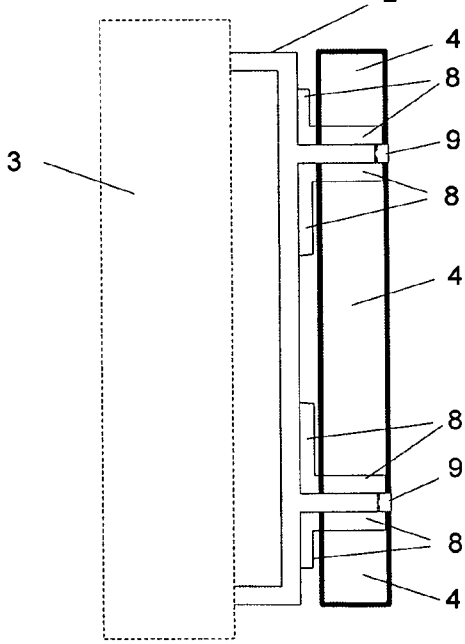
FIG. 6 illustrates a side view of anti vibrating mounting means of the invention.

In FIG. 6 a side view illustrates details of how a loudspeaker assembly (4) is mounted on to the chassis (2) of a multimedia device, e.g. on the backside of a TV set containing a display screen (3). The loudspeaker assembly (4) is mounted by anti vibrating means (8,9) on to the frame (2).

In a preferred embodiment the anti vibrating means include shock isolation material (8) e.g. rubber, the material absorbs the acoustical vibration from the loudspeaker unit. Supporting means like a connection piece mounted onto the frame (2) and a fixation nut (9) including absorbing means constitute the fixture of the loudspeaker assembly onto the frame of the multimedia device.

Alternative anti vibrating means may include miscellaneous technologies, but not limited to: PVC foam, springs, composites of mineral wool and alike.

Alternative supporting means may include, tubes welded or screwed on to the frame and/or clips of any type. The material of the supporting means may include metal, PVC, nylon and plastic composites and alike.

The invention claimed is:

1. A loudspeaker assembly arranged in a multimedia apparatus, where said multimedia apparatus comprises a front side which in use faces a user and a back side opposite said front side, where the front side has a substantially planar surface defining an X-Y plane and a Z axis arranged orthogonal to the X-Y plane, wherein the loudspeaker assembly, including at least one transducer unit, is located at the back side of the multimedia apparatus, and wherein a sound radiating surface of the transducer unit, configured to radiate sound primarily upwards, is declined approximately 15 degrees relative to the Z axis.

2. A loudspeaker assembly according to claim 1, where the loudspeaker assembly is an object mounted via anti vibrating means (8, 9) onto a part of the chassis frame (2) of the multimedia apparatus.

3. A loudspeaker assembly according to claim 1, where the loudspeaker assembly is an object mounted via anti vibrating means (8, 9) onto a part of the support stand (12) of the multimedia apparatus.

4. A loudspeaker assembly according to claim 1, where the transducer (S) is a woofer.

5. A loudspeaker assembly according to claim 1, where each of the one or more transducer units is driven as an active speaker, with means for amplification per each transducer unit (S).

6. A loudspeaker assembly according to claim 1, where the multimedia apparatus is a unit of any type having the capability to generate sound output, and/or where the multimedia apparatus is a unit of any type having graphical display means including a screen.

7. A loudspeaker assembly according to claim 1 wherein said assembly is configured with one or more loudspeaker assemblies (4) where each assembly is configured with one or more transducer units (S).

8. A loudspeaker assembly according to claim 7, where the assembly comprises one transducer (S) which is a low frequency transducer and/or a transducer being a medium frequency transducer and/or a transducer being a high frequency transducer.

* * * * *